US006860080B2

(12) United States Patent
Trabucco

(10) Patent No.: US 6,860,080 B2
(45) Date of Patent: Mar. 1, 2005

(54) THREE DIMENSIONAL SCULPTURE

(76) Inventor: Victor A. Trabucco, 10 Paddock View, Clarence, NY (US) 14031

( * ) Notice: Subject to any disclaimer, the term of this patent is extended or adjusted under 35 U.S.C. 154(b) by 0 days.

(21) Appl. No.: 10/270,952

(22) Filed: Oct. 15, 2002

(65) Prior Publication Data

US 2004/0071898 A1 Apr. 15, 2004

(51) Int. Cl.[7] ..... E04C 2/54
(52) U.S. Cl. ..... 52/786.11; 40/800
(58) Field of Search ..... 52/204.61, 456, 52/786.11, 663, 311.3, 311.1, 106; 248/27; 40/800, 768, 780; 312/114

(56) References Cited

U.S. PATENT DOCUMENTS 4,033,325 A * 7/1977 Walker ..... 126/638
5,477,647 A * 12/1995 Yates, Jr. ..... 52/204.57
5,834,124 A * 11/1998 Pease et al. ..... 428/430
6,598,282 B2 * 7/2003 Robles Gil-Bueno ..... 29/455.1

* cited by examiner

*Primary Examiner*—Naoko Slack
(74) *Attorney, Agent, or Firm*—James J. Ralabate

(57) ABSTRACT

The subject of this invention is the presentation of a three dimensional glass sculpture depicting realistic subjects such as flowers, leaves, birds, animals or abstract shapes in a decorative window. This is an alternative to stain glass or beveled glass windows which are basically a two dimensional presentation.

10 Claims, 5 Drawing Sheets

THREE DIMENSIONAL SCULPTURE

This invention relates to a three dimensional sculpture and, more specifically, to mounting a three dimensional sculpture in a frame that is protected between two panels, at least one being a glass panel or frame.

BACKGROUND OF THE INVENTION

It is known to use a stained glass window or stained glass panel between two panes of glass. This decorative structure is then used for interior or exterior windows or doors. Generally, the stained glass panel is inserted between the two exterior glass panes, with two exterior panes being the means for holding the decorative stained glass panel in place. An alternative holding means would be for the stained glass panel to be adhered around its periphery to the protective exterior glass panes. There is no prior art known, however, where a sculptured three dimensional sculpture is positioned between two protective panes or panels as in the present invention.

Various stain glass and beveled glass designs have been installed between glass panels in an insulated glass unit for interior or exterior use. The stain glass or beveled glass panel is usually set between the outer protective glass and gives the viewer basically a two dimensional design. The process to produce a stain glass or beveled glass design involves the use of what is called in the industry cold glass techniques, wherein glass is cut, sawn, ground and/or polished and the use of lead, brass, copper foil and solder are used to join the elements of the design together. The finished glass design is then installed between the glass panels of an insulated glass window. The completed insulated unit is mounted in a window sash, as normal.

In U.S. Pat. No. 1,599,779 (Michlinski et al.), an ornament or molded figure is secured to the inner face of a protective panel. Michlinski is concerned with ornaments for hanging on the wall of dwellings with its principal object to provide an ornament embodying a frame to which a panel is secured, the panel having a scene or picture painted thereon. The backing or panel of Michlinski serves as part of a casing for retaining the pictured panel in place.

In Ostergaard et al, U.S. Pat. No. 2,823,478 a holding frame for mounting picture-caring film strips for viewing is disclosed. To avoid discoloration of a picture on a film strip without reducing the length of the picture, he coordinates the location of a fastening pin or pins and the length of the picture aperture with a hole in the side perforations of the film strip.

Neither of the two recited prior art references are concerned with a three dimensional sculpture mounted between two glass or other panels and the problems associated with such a structure.

SUMMARY OF THE INVENTION

The present invention is directed to mounting a three dimensional glass (or other) sculpture between two protective panes or panels, such as in an insulating window or door. The present invention is primarily concerned with the presentation of a three dimensional glass or other sculpture depicting abstract or realistic objects, such as flowers, leaves, birds, animals, or other items in a decorative window, door, wall piece, transom, or freestanding sculpture for residential or commercial use.

The insulated window is constructed by the standard method of insulated glass window technology. Using window glass preferably tempered or any suitable material, such as acrylics, polycarbonate materials, or safety glass, the panes of glass are usually separated by a desiccate track and joined together with a sealant usually Butyl or Silicone. An alternative insulated glass window can also be fabricated by a frame with a removable glass panel with a gasket to seal the unit and has vent holes to prevent condensation. In either case, the glass sculpture is installed between the panes of glass to create a functional and decorative window.

In some installations the unit can also be constructed substituting the back glass panel with non glass panels or with other decorative glass, such as frosted glass, textured glass, beveled glass, stained glass, mirror, wood, metal, or plastics.

The preferred method of fabrication of the decorative glass sculpture is created by a process called lamp working or flame work, wherein clear glass or colored glass is shaped or formed in the flame of a torch to create the desired glass sculpture. Molded glass, cast glass, blown glass and other decorative materials, such as metal, plastics (acrylic, polycarbonate, etc.) can be used to create the sculpture or elements added to the sculpture.

The sculpture is then affixed in a frame preferably aluminum but alternative materials such as wood, plastics, metals, glass, and other synthetic materials can be used. The preferred method of joining the sculpture to the frame is to use glass dowels with a vinyl sleeve. The dowels are usually ½ inch in diameter with a vinyl sleeve that fit a ¾ inch hole in the frame or a smaller hole can be used without the vinyl sleeve, and adhesives such as silicone or epoxies can bond the sculpture to the frame.

An alternative method to affix the sculpture to the frame is to simply surface mount the sculpture to the frame using an adhesive such as silicone or epoxy without the use of dowels. Clips, wire, straps, screws or friction fit are all possible methods of affixing the sculpture to the frame. Metal sculptures can be mounted using a number of methods, such as soldering, brazing, welding.

It is therefore an object of this invention to provide a three dimensional decorative structure glass or metal useful in or as a door or window or other suitable object.

Another object of this invention is to provide a convenient and reliable way to mount a three dimensional sculpture in a suitable structure where the sculpture is protected by glass or other transparent panels, where at least one of two panels is transparent.

Yet another object of this invention is to protect a three dimensional sculpture in an insulating door or window structure.

Another further object of this invention is to present a three dimensional glass (or other) sculpture either realistic or abstract that is protected by at least one front transparent pane or panel and a back that is transparent or not.

Still another object is to provide a glass sculpture in a dust-free, moisture tight window or door unit that can be used as a functional insulated window or door for external or interior use.

These and other objects of this invention are accomplished by a structure comprising a three dimensional glass sculpture, realistic, or abstract, that is attached to a frame and that is protected by panes or panels in the front or back. At least one of these panes or panels must be a transparent panel, such as glass, plastics or another suitable transparent pane. The structure of this invention must be a dust free moisture tight window unit for external or internal use.

When the term "window" is used throughout this disclosure and claims, it is intended that windows, transoms, doors, free standing sculptures, or other suitable structures such as Thermopane windows are contemplated. When the term "glass" is used, it is intended that any transparent material is also contemplated. When the term "three dimensional" is used, it means a structure has three dimensions, i.e., height, width and depth and having an actual or illusion of depth.

DETAILED DESCRIPTION OF THE DRAWING AND PREFERRED EMBODIMENT

Figure 1:
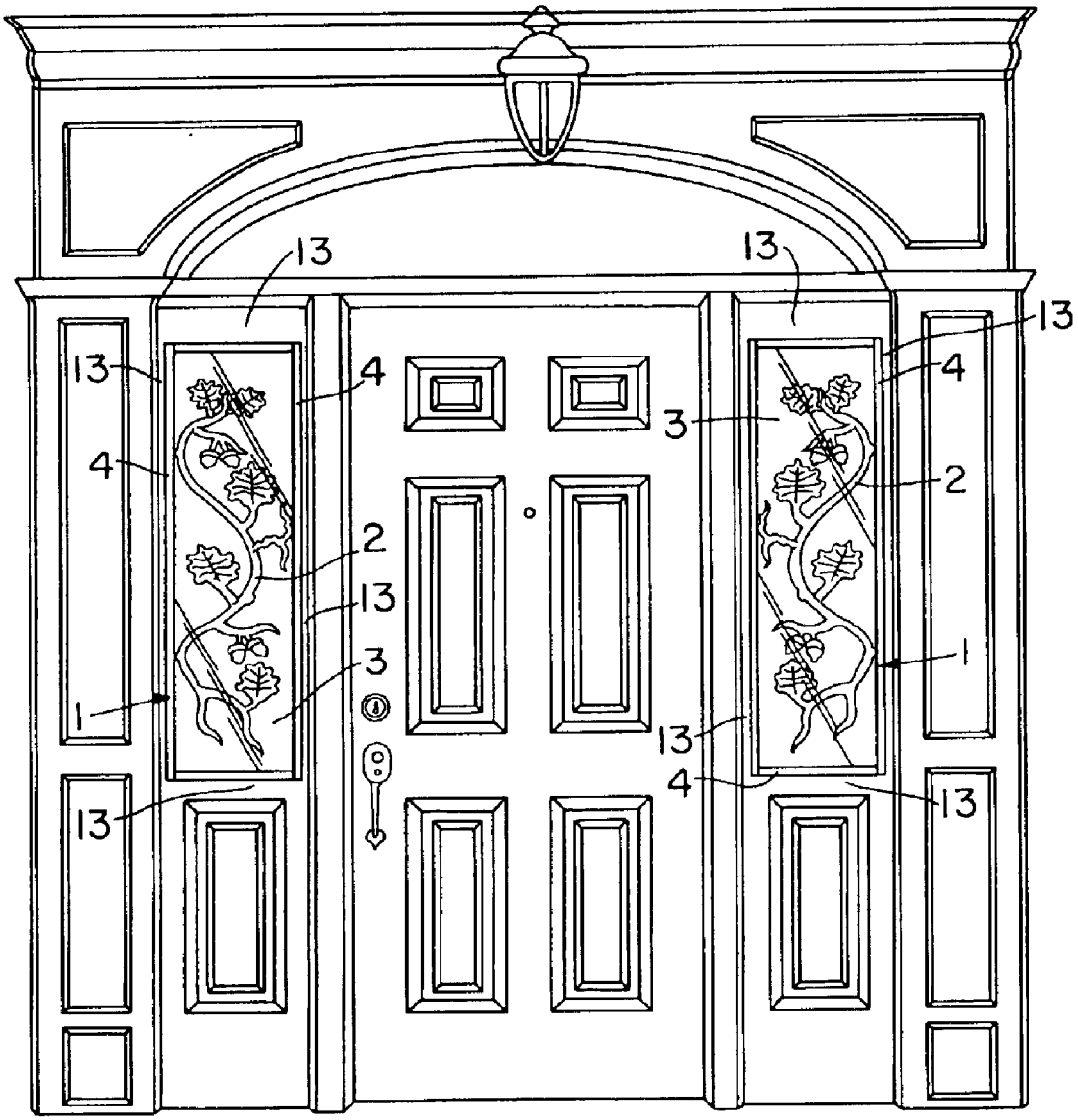
FIG. 1 is a plan view of the assembled structure of this invention used in a side window of a door entrance.

In FIG. 1 a use of the structure 1 of this invention is illustrated. Structure 1 in this embodiment is used as a window having the three dimensional decorative sculpture 2 presented between two protective panels, at least the front pane or panel 3 being transparent. A problem with mounting glass or other fragile sculptures is that unless it is securely mounted, it can easily break, especially if used on a door or other moving items. The structure 1 comprises a frame 4 to which sculpture 2 is attached, sculpture 2, and two exterior panels 3 a front and a back exterior panel. At least the front panel 3 must be transparent such as for example a glass pane. It is preferred that the assembled structure be hermetically sealed such as in Thermopane windows to prevent any moisture and dust and the like to form internally between the panes or panels 3. However, if this is not desired, a gasket seal 15 with a vent hole 14 may be used.

Figure 2:
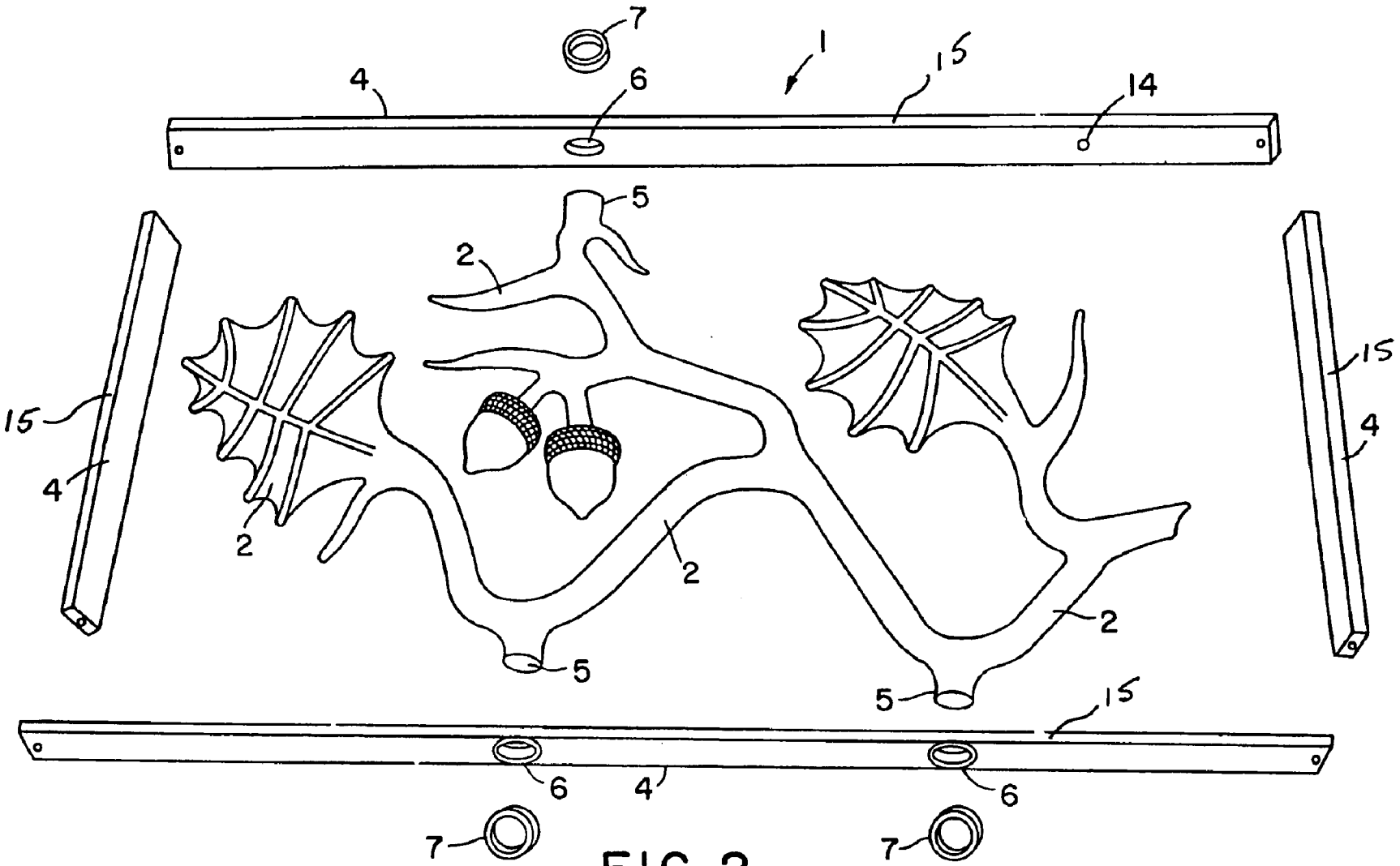
FIG. 2 is a perspective detached view of one embodiment of the structure of the present invention using a dowel connecting means.

FIG. 2 illustrates a disassembled structure 1 in one embodiment of this invention. Structure 1 as above noted comprises a three dimensional glass sculpture 2 enclosed between two panels 3 (not shown in this figure) and a frame 4 to which sculpture 2 is attached. In the embodiment of FIG. 2 a sculpture 2 is attached to frame 4 by the use of dowels 5. There are holes or apertures 6 in frame 4 to accommodate flexible rings 7 through which the dowels will tightly fit. Once the structure 1 is fully assembled and sculpture 2 is mounted in place, the flexible rings 7 provide ample cushioning protection to the glass or other dowels 5 placed therein. While the dowel 5 connection is a preferred embodiment, any suitable connection means to mount sculpture 2 to frame 4 may be used; for example, any groove fitting a frame track with a corresponding sculpture fitting or friction fit, an adhesive (as shown in FIG. 3) or any other suitable connection or attachment means, or mixtures thereof.

Figure 3:
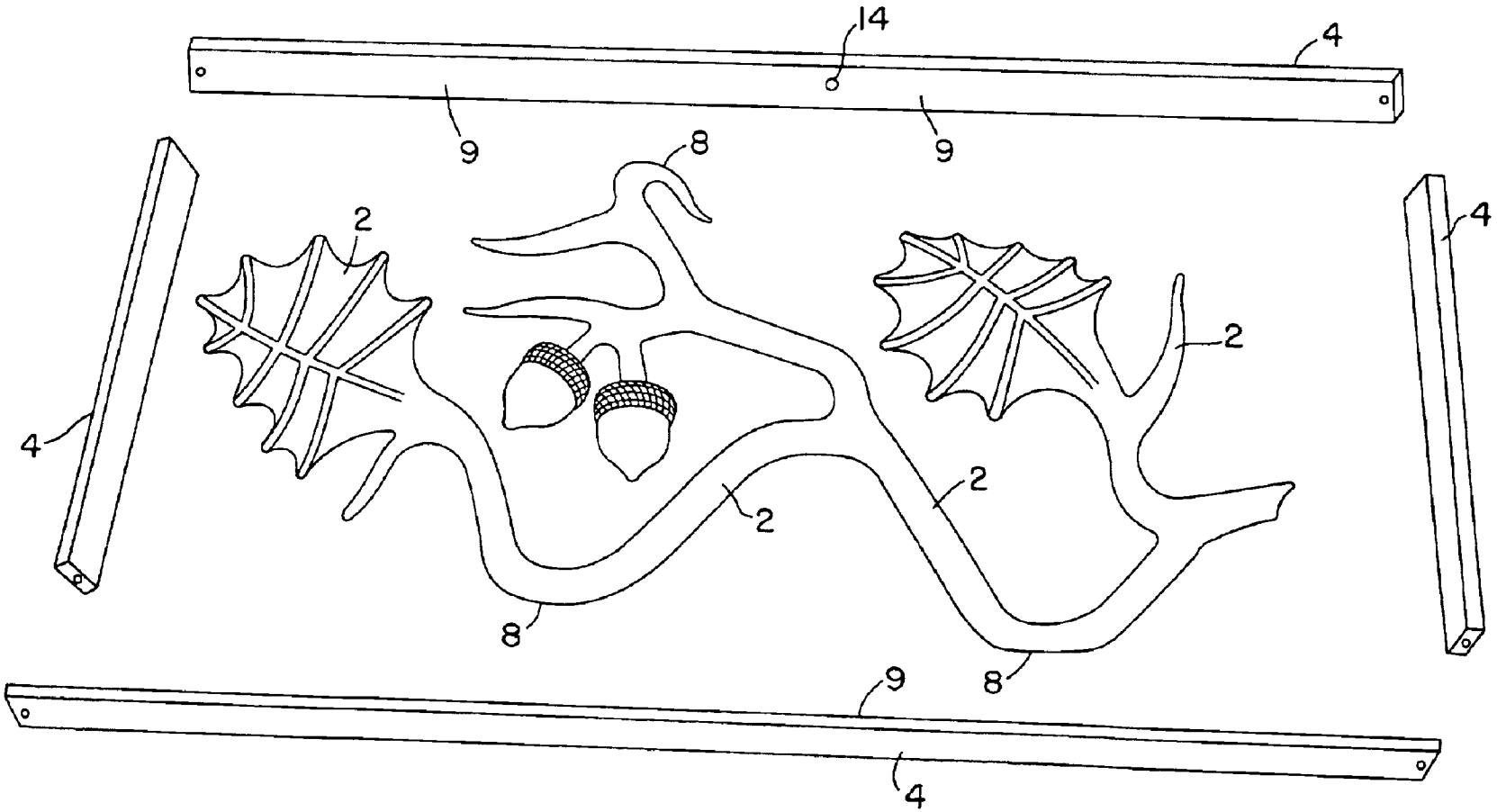
FIG. 3 is a perspective detached view of another embodiment of the present invention using an adhesive connecting means.

As shown in FIGS. 2 and 3 the sculpture 2 has a cylindrical, cross-sectional configuration (three dimensional) through at least a portion of its body. It is preferred that a major portion of sculpture 2 be cylindrical except for leafs or other flat objects. The rounded dowels 5 are a continuation of the rounded or cylindrical configuration of sculpture 2. Either dowel 5, projecting sculpture surface 8 or the tenon 11 of FIG. 4 can be used as the connection means. The end portion of the projecting surface 8 adjacent the frame 4 is somewhat flat for better connection to the frame as shown in FIG. 3 but substantially the remainder of sculpture 2 is cylindrical except for flat representations such as leaves etc. When tenon 11 is used, it is preferred that a rounded tenon is used to fit into rounded aperture 12.

As shown in all of the Figures, the connecting means are attached to the frame only in a non-uniform, random manner or pattern. By connecting means randomly attached to adjacent portions of the frame 4 in a non-uniform manner, the best arrangement can be determined for secure attachment. Adhesives may be used alone or with dowels 5 or tenons 11. Whatever connecting means are used, it is important that the sculpture 2 is maintained substantially immovable within the housing.

In FIG. 3 an embodiment using an adhesive or glue connecting means is illustrated. A sculpture surface 8 is glued to the inside surface 9 of frame 4. Once sculpture 2 is glued to frame 4, the two glass panels 3 are fitted over the frame such as in an insulating window. As above noted, the back panel 3 may be other than glass and may be made from any suitable material such as wood, metal, plastic, frosted glass, stained glass or mixtures thereof. It is critical to this invention, however, that at least one panel (front or back) be transparent such as a glass pane, plastic that is transparent, or other suitable transparent materials. The frame 4 as noted earlier can be made of aluminum, metals other than aluminum, wood, plastics, glass, plexiglass, ceramics, or mixtures thereof.

Figure 4:
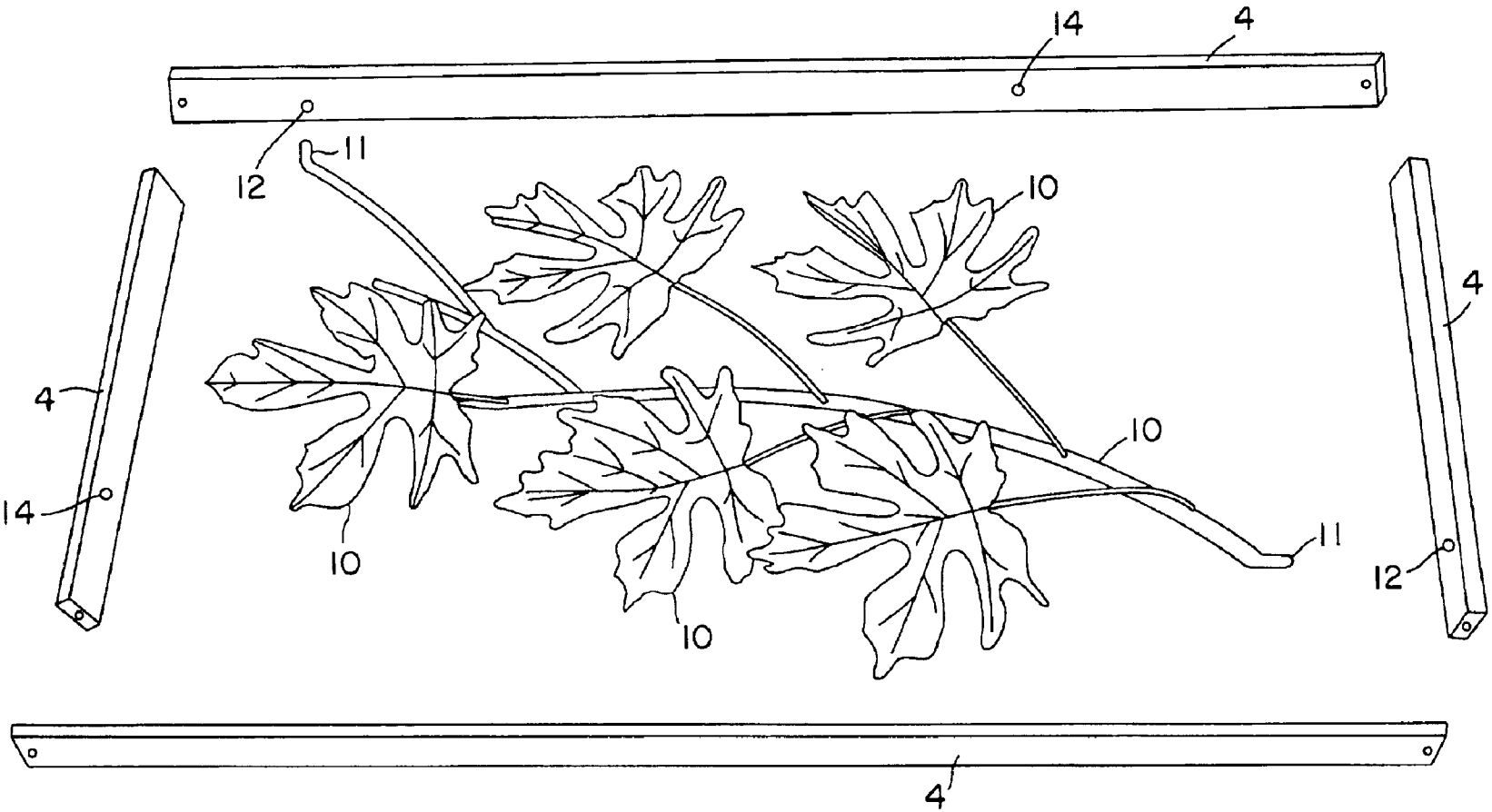
FIG. 4 is a perspective detached view of yet another embodiment of the present invention using a metal sculpture.

FIG. 4 illustrates a three dimensional metal sculpture 10 attached to frame 4 by a metal projecting end or tenon 11 which fits into a mounting hole 12 in the inner surface 9 of frame 4. As in the other earlier figures, the glass panes or panels 3 are fitted around and attached to frame 4 once the sculpture 10 has been connected to the frame 4. Obviously, an adhesive could also be used in this embodiment rather than the tenon 11 and hole 12, but the embodiment shown is highly preferred for this embodiment.

Figure 5:
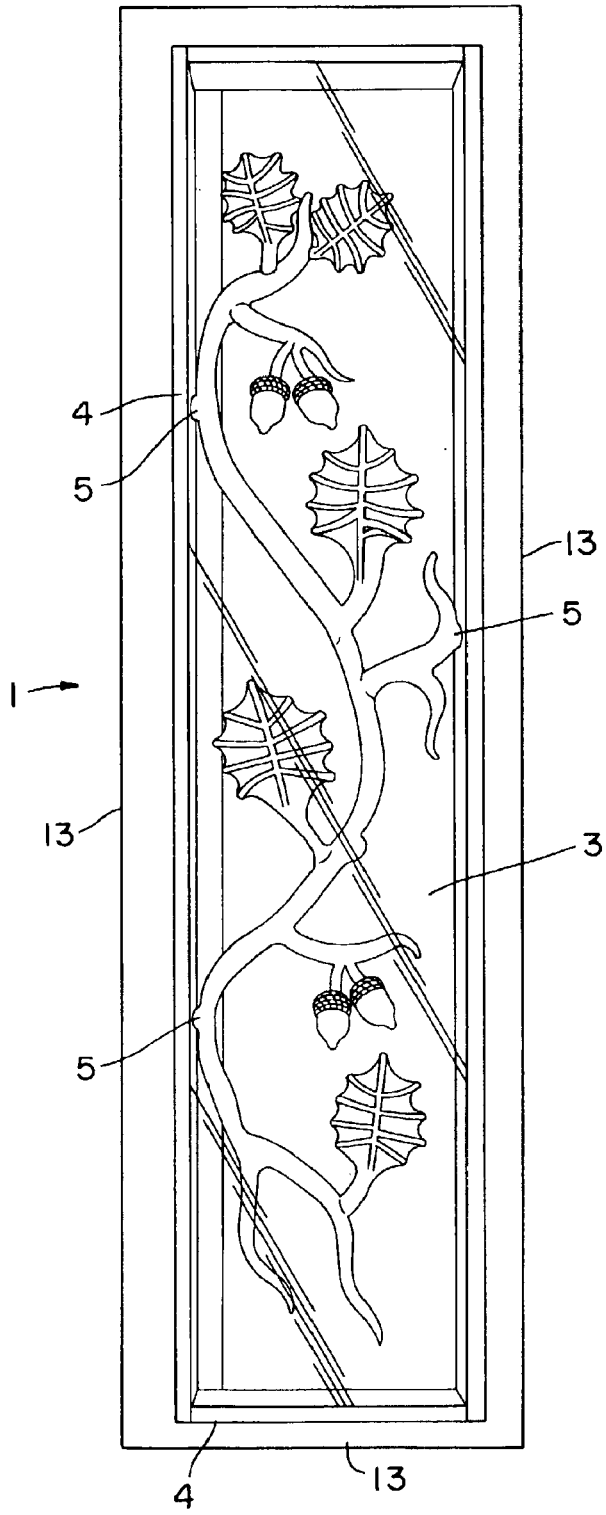
FIG. 5 is a plan view of an installed sculptured unit in an assembled dust free window unit.

In FIG. 5 the completely assembled structure 1 is illustrated. Comprising structure 1 is frame 4, sculpture 2, front transparent glass pane or panel 3 and rear transparent or not panel 3. The back panel 3 can be plain or have a designed or decorative surface, such as frosted glass, or etched metal, or as in the preferred embodiment transparent glass such as in an insulated window. Frame 4 can be separate from or integral with a supporting frame work 13, such as a window, door or other outer structure. A preferred structure of this invention would comprise a sculpture 2 positioned between the panes of a Thermopane window such as those manufactured by Pella or Anderson window companies.

The preferred and optimumly preferred embodiments of the present invention have been described herein and shown in the accompanying drawings to illustrate the underlying principles of the invention but it is to be understood that numerous modifications and ramifications may be made without departing from the spirit and scope of this invention.

What is claimed is:

1. A decorative art structure comprising a decorative sculpture, a frame, front and back protection panels, and means for connecting said sculpture to said frame, at least one of said panels being made of a transparent material, said sculpture comprising in a major portion thereof a cylindrical configuration, said sculpture having projecting portions that are connected at non-uniform adjacent portions in said frame to said frame by connecting means including cylindrical dowels, tenons and adhesives, when said dowels are used they are inserted into and connected to an aperture in said frame, when said tenons are used said tenons are connected to adjacent portions of said frame by an aperture connection, said adhesive optionally used alone or with said tenon or said dowels, said sculpture connected by said connecting means to adjacent portions of said frame at non-uniform locations so that said sculpture is maintained substantially immovable within a housing of said structure.

2. The structure of claim 1 wherein said frame can be rigid or flexible and said frame is comprised of a material selected from the group consisting of metal, wood, plastic, fiberglass, glass and mixtures thereof.

3. The structure of claim 1 wherein said sculpture is glass, said frame is aluminum and said panels are both made of transparent glass.

4. The structure of claim 1 wherein said housing has at least one vent hole to prevent condensation from forming within said housing.

5. A decorative art structure comprising a three dimensional decorative sculpture, a frame, front and back protection panels, and means for connecting said sculpture to said frame, said sculpture selected from the group consisting of abstract and realistic objects or mixtures thereof, said frame substantially coextensive with said panels, and at least one of said panels being made of a transparent material, said sculpture being connected to and housed within said frame and said panels fitting over front and back portions of said frame to form a housing completely enclosing said sculpture, said sculpture being at least in part substantially cylindrical and having projecting portions selected from the group consisting of dowels and tenons which have connecting means that are connected to said frame at only non-uniform positional adjacent portions of said frame, when said dowels are used, they are inserted and connected to an aperture in an adjacent portion of frame, when said tenons or projecting portions are used said projecting portions are connected to said adjacent portions of said frame by an aperture or by an applied adhesive, said three dimensional sculpture connected by said connecting means to said frame at only portions adjacent said connecting means, said sculpture secured thereby so that it is maintained substantially immovable within said housing.

6. The structure of claim 5 wherein said three dimensional decorative sculpture is selected from the group consisting of glass and metal.

7. The structure of claim 5 wherein said connecting means comprises an adhesive applied to adjacent portions of at least the frame or said sculpture.

8. The structure of claim 5 wherein at least one of said front and back protection panels is transparent.

9. The structure of claim 5 wherein said housing is substantially a moisture and dust free housing.

10. The structure of claim 5 wherein said housing has a gasket seal and at least one vent hole to prevent condensation from forming within said housing.

* * * * *